US005875660A

United States Patent [19]

Olshausen

[11] Patent Number: 5,875,660

[45] Date of Patent: Mar. 2, 1999

[54] ANTI-SNOOPING DEVICE FOR APARTMENT DWELLERS

[76] Inventor: Michael Cohnitz Olshausen, 119 Jefferson Ave. Apt. 3, Bristol, Pa. 19007

[21] Appl. No.: 890,516

[22] Filed: Jul. 9, 1997

[51] Int. Cl.[6] ..... E05B 65/06

[52] U.S. Cl. ..... 70/93; 70/50; 70/422; 70/440; 70/DIG. 12; 292/264; 292/282

[58] Field of Search ..... 70/92, 93, 50, 70/422, 439, 440, 465, DIG. 12, DIG. 59; 292/92, 264, 282, 284, 286, 287, DIG. 65

[56] References Cited

U.S. PATENT DOCUMENTS

| | | | |
|---|---|---|---|
| 653,799 | 7/1900 | Giebel et al. | 70/440 |
| 742,085 | 10/1903 | Thompson | 292/313 |
| 1,164,877 | 12/1915 | Schulz | 70/422 |
| 1,811,993 | 6/1931 | Berry | 70/465 |
| 2,118,635 | 5/1938 | Zingman | 70/93 |
| 2,301,116 | 11/1942 | Gusbeth | 70/163 |
| 2,401,965 | 6/1946 | Rossiter | 70/465 |
| 2,666,318 | 1/1954 | Welch | 70/50 |
| 3,134,252 | 5/1964 | Mintz | 70/93 |
| 3,161,035 | 12/1964 | Adamec et al. | 70/93 |
| 3,274,809 | 9/1966 | Kozlowski | 70/163 |
| 3,313,198 | 4/1967 | Walton | 411/910 X |
| 3,667,794 | 6/1972 | Lentz, Jr. | 292/264 |
| 3,788,107 | 1/1974 | Lippman | 292/264 X |
| 4,082,333 | 4/1978 | Segal | 292/264 |
| 4,900,075 | 2/1990 | Smith | 292/263 |
| 4,974,889 | 12/1990 | North | 292/317 X |
| 5,520,032 | 5/1996 | Ling | 70/25 |
| 5,704,097 | 1/1998 | Rahav | 292/317 X |

FOREIGN PATENT DOCUMENTS

| | | | |
|---|---|---|---|
| 22135 | 10/1911 | United Kingdom | 70/93 |
| 246023 | 1/1926 | United Kingdom . | |
| 584751 | 1/1947 | United Kingdom . | |
| WO 89/04414 | 5/1989 | WIPO | 292/264 |

*Primary Examiner*—Lloyd A. Gall

[57] ABSTRACT

An anti-snooping device for doors to apartments comprising a locking mechanism and a relatively low-strength, "tamperproof" seal capable of engaging the locking mechanism, the locking mechanism being capable of disengagement without, however, compromising the "tamperproof" seal. The invention's preferred embodiment is a chain door lock in which one of the chain's links has been replaced by a coded, colored, plastic, "tamperproof" seal. To enter the apartment, the apartment dweller uses, first, her door key and then, second, the key to or, alternately, the combination of, the anti-snooping device. Entry by anyone else must be effected by breaking the "tamperproof" seal or by breaking or successfully picking the anti-snooping device's lock.

16 Claims, 3 Drawing Sheets

ANTI-SNOOPING DEVICE FOR APARTMENT DWELLERS

BACKGROUND OF THE INVENTION

This invention relates generally to door security devices, and more particularly it relates to a novel type of seal door lock. The present invention provides a solution to the apartment dweller's dilemma: how to guarantee freedom of entry to building maintenance personnel to make unscheduled, but necessary repairs while at the same time deterring snooping and wrongful entry by persons with privileged access to the apartment dweller's door key.

An ordinary seal lock is inconvenient for this purpose, because the seal must generally be replaced after each authorized entry. Few apartment dwellers will want such a fussy device.

On the other hand, a seal lock whose appearance is quite unfamiliar, or one that involves a mechanical linkage without provision for a visually obvious, breakable seal, may seem to a management agent to be a serious obstacle to entry. In an emergency, time may be lost looking for a hacksaw, and a liability may thus be incurred by the apartment dweller.

BRIEF SUMMARY OF THE INVENTION

There are two, common types of seal lock. The first type is constructed such that a failed attempt to open the lock will break, or otherwise visibly compromise, a so-called "tamperproof seal", referred to hereinafter as the "seal", but will leave the lock itself intact (examples are U.S. Pat. Nos. 653,799 and 2,666,318). The items protected by the lock remain protected and only the unauthorized attempt at entry is revealed. The lock itself must still successfully be picked, or else broken, or the key (combination) must be stolen to gain unauthorized entry. In the second type of seal lock (an example is U.S. Pat. No. 742,085), the locking function is performed by the seal itself, so that breakage of the seal results in immediate access to the protected items. In both types of traditional, seal lock, the seal must be broken to gain access to the protected items.

The present invention creates a third, novel type of seal door lock by providing for two, independent methods of entry. The first method is traditional and is intended for those occasions when an emergency repair must be made. Lease-authorized entry in an emergency is achieved when an agent of the building management company simply breaks the seal which is part of the present invention. The seal is weak relative to the invention's other components, and the agent needs merely to push open the apartment dweller's door to break the seal. The management company, by pointing to visible repair work and/or to fresh damage and/or to receipts for parts and/or labor, should have no trouble explaining afterwards the nature and the urgency of the repair and, hence, the agent's legitimate, unscheduled entry.

The present invention also affords a second method of entry, for use by the apartment dweller. This non-traditional method of authorized entry is accomplished by disengaging a lockable, key-operable (alternatively, a combination-operable) coupling. This coupling in turn engages both the seal and an anchorage mounted either to the door-frame or to the door. Disengaging the lockable coupling has the novel effect of preserving the physical integrity of the weak seal. In this respect, the present invention is unlike all other seal door locks.

The present invention also allows an apartment dweller to provide a set of individually coded, brightly colored seals (e.g. in red, orange, yellow, florescent white, or the day-glo colors) to a trusted friend, who then can water plants or care for pets in the apartment dweller's absence, while the apartment dweller continues to retain possession of his/her key (combination) to the device. The trusted friend achieves her authorized entry by opening the apartment door slowly, noting the condition of the coded seal, and then by cutting or breaking that coded seal. The trusted friend is thereby enabled to detect and later to report unexpected and, possibly, illegitimate entry. After leaving the apartment, the trusted friend turns and replaces the broken seal with a fresh seal carrying a different serial number through the gap between the door and door jamb. When the apartment dweller returns, the trusted friend reports her observations and gives back the unused seals, plus those seals broken by the trusted friend's authorized entry.

If no repair work, or other, legitimate reason for unscheduled entry is apparent, then a broken seal becomes prima facia evidence of unauthorized entry. The management company might be confronted, or a police report might be filed, or a lawyer notified.

One embodiment of the present invention incorporates a standard, chain door lock, of which numerous patented types disclose a chain having two parts joined by an intervening member (examples are U.S. Pat. Nos. 4,082,333 and 3,667,794) or else joined by a padlock and/or an intervening member (examples are U.S. Pat. Nos. 4,900,075 and 3,274,809). None of these inventions, however, discloses an intervening member that is weak relative either to the chain or the invention's other, component parts. British Patent 21,844 discloses a padlock that has two hasps, but neither hasp is weak relative to the other components of the invention, and both hasps are permanently attached to the body of the padlock.

With the foregoing in mind, it is an important object of the present invention to provide an apartment dweller with an easily operable, inexpensive device that guarantees freedom of entry to building maintenance personnel to make unscheduled, but necessary repairs, yet that deters wrongful entry and/or snooping by anyone with privileged access to the apartment dweller's door key.

It is yet another object of the present invention to deter, by means of colored seals readily visible to anyone who starts to open the apartment dweller's door, that person's wrongful entry and/or snooping.

It is yet another object of the present invention to furnish the apartment dweller with individually coded seals, so that, in the event of an unauthorized entry, the apartment dweller obtains immediate, prima facia evidence that an unauthorized entry has occurred.

It is yet another object of the present invention to permit an apartment dweller to judge whether it is safe to enter his or her apartment. A broken seal at once being evident, the apartment dweller may choose to call for assistance prior to entering.

The above and still further objects and advantages of the present invention will become apparent from a consideration of the following detailed specification, appended claims, and drawings.

BRIEF DESCRIPTION OF THE SEVERAL VIEWS OF THE DRAWING

Referring to the drawings, wherein like reference characters indicate like parts or elements throughout the several views.

DETAILED DESCRIPTION OF THE INVENTION

Figure 1:
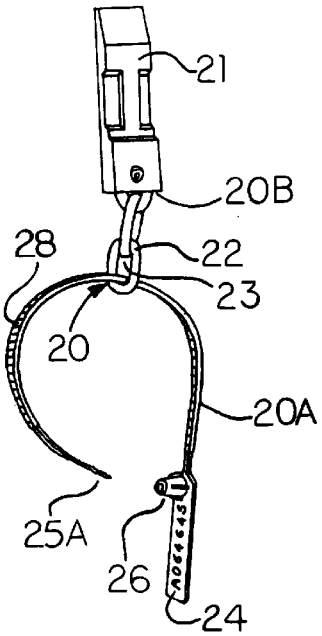
FIG. 1 is a perspective view of the dual-strength connector of one embodiment of the present invention, showing said dual-strength connector lying on a plane, said perspective taken from slightly to the left of a perpendicular dropped to the said plane.

FIG. 1 shows dual-strength connector 20, comprising low-strength seal 20A, preferably made of plastic, and relatively high-strength coupler 20B, preferably made, like all of the other components of the present invention except the said low-strength seal, out of metal and itself comprising link chain 22 and lug 21. Said low-strength seal 20A is shown passing through aperture 23 of relatively high-strength coupler 20B, prior to irreversible engagement of seal 20A with itself. The variety of adjustable, "tamper-proof" seal shown in FIG. 1 is one of several, similar varieties available commercially, and has features typical of the genera. Low-strength seal 20A thus has a short, narrow, male end 25A, a much longer midsection 28, and a female-receptacle element 26 at its other end. Male end 25A is to be inserted in, and drawn through, female-receptacle element 26. Internal to female-receptacle element 26, and varying in exact design from manufacturer to manufacturer, is a generally pawl-like mechanism which irreversibly engages the ratchet-like divisions along the midsection 28 of seal 20A. As male end 25A is pulled, seal 20A is brought into irreversible engagement with itself, so that a series of smaller and smaller loops results. Seal 20A carries serial number 24.

Figure 2:
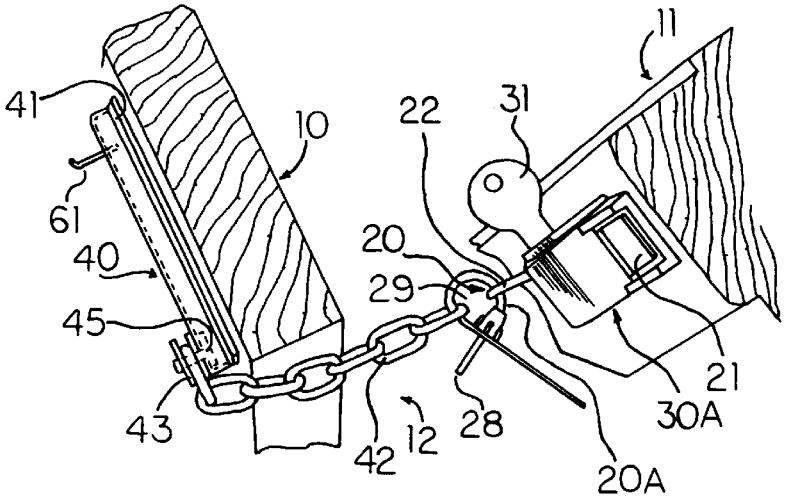
FIG. 2 is a perspective view of one embodiment of the present invention, showing two anchorages mounted, respectively, to a door and door-frame member, and showing the said anchorages connected to one another by the dual-strength connector shown in FIG. 1, and showing the said door ajar, said perspective being taken from a steep angle to a plane perpendicular to the plane of the said door.

FIG. 2 shows an apartment door 10 and door-frame member 11 with gap 12 between them when the said door 10 is ajar. Mounted on door 10 is one anchorage 40 of the invention, comprising link chain 42, chain head 43, and mounting device 41. Chain head 43 is held to mounting device 41 by rivet 45, but is otherwise free to move along a slot in mounting plate 41, said slot being shown in FIGS. 3 and 4. Hook 61 extends through mounting plate 41. A second anchorage 30A is shown mounted on door-frame member 11. Lug 21 of dual-strength connector 20 is shown in engagement with anchorage 30A, said engagement being reversibly lockable. Working key 31 in anchorage 30A releases lug 21, thus severing the lockable engagement of dual-strength connector 20 with anchorage 30A. In the steep perspective view of FIG. 2, link chain 22 of dual-strength connector 20 is shown emerging from below anchorage 30A. Said dual-strength connector 20 is also shown engaged with anchorage 40 by means of the passage of low-strength seal 20A through one of the links of said link chain 42 and by the subsequent, irreversible engagement of low-strength seal 20A with itself. Said low-strength seal 20A is capable of a size adjustment, said size adjustment occurring as male end 25A, shown in FIG. 1, is drawn irreversibly through female-receptacle end 26 to form loop 29, said loop thus growing irreversibly smaller. The excess length of seal 20A may be snipped off, resulting in truncated end 25B. For the specific variety of adjustable seal shown in FIGS. 1, 2 and 3, a final loop size about equal to the size of one link of link chain 42 is generally recommended, for then the reuse of a broken seal 20A, difficult in any case because of the relative narrowness of gap 12, becomes no longer practically possible. However, the relatively great, initial length of midsection 28 of seal 20A, shown in FIG. 1, compared to the final, recommended loop size, becomes advantageous for someone, such as a trusted friend, who wishes to replace a broken seal 20A with a fresh seal 20A bearing a different serial number 24 through the relatively narrow gap 12 after leaving the said apartment. Said engagement of said dual-strength connector 20 with the said anchorages 30A and 40 having been effected, said anchorage 30A in combination with said dual-strength connector 20 and said anchorage 40 together form a connected span linking said door 10 with said door-frame member 11, said span being sufficiently short as to prevent a human being from squeezing between the said door and the said door frame.

Figure 3:
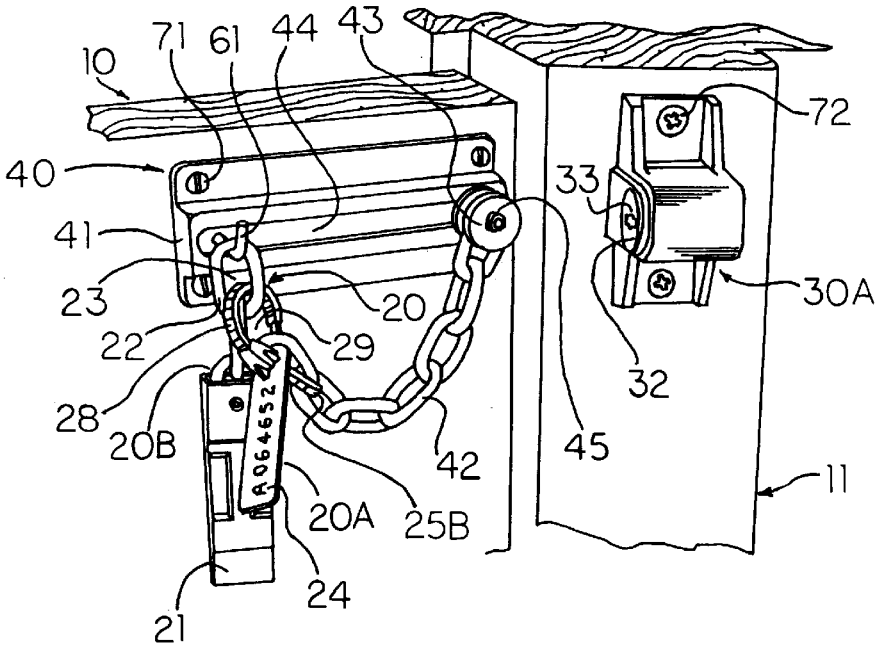
FIG. 3 is a perspective view of the embodiment of the invention shown in FIG. 2, but showing the said anchorages unconnected and the said door closed, said perspective being taken from slightly to the left of and above a perpendicular dropped to the said door.

FIG. 3 shows the same embodiment of the invention shown in FIG. 2, but in the stowed position, with link chain 22 of high-strength coupler 20B draped over hook 61. Lock cylinder 32 of anchorage 30A may be worked by inserting key 31 into aperture 33. Chain head 43 may be moved along slot 44 over at least some substantial portion of the length of slot 44. This movement of chain head 43 may become advantageous to the user of the present invention who wishes to engage and, subsequently, to disengage the said dual-strength connector 20 while he/she is within the said apartment. This will be particularly true if the said anchorages 30A and 40 inadvertently have been mounted so that they lie close to one another when the door 10 is closed. In such an event, the insertion of key 31 into aperture 33 will be greatly facilitated by moving chain head 43 along slot 44, and away from anchorage 30A. Hook 61 extends through slot 44, near one end of the said slot. Mounting plate 41 is shown attached to door 10 with ordinary, slotted screws 71.

Figure 4:
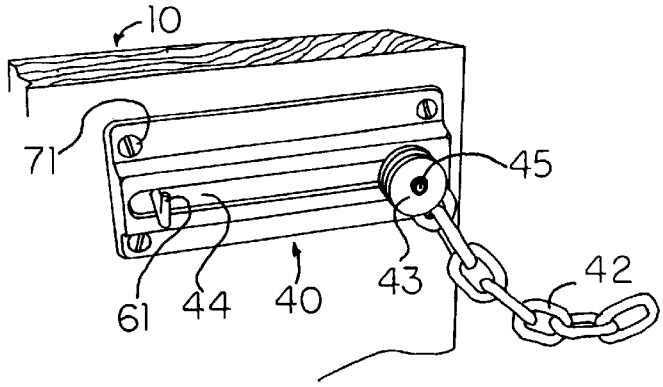
FIG. 4 is a perspective view of the door-mounted anchorage of the embodiment of the invention shown in FIGS. 2 and 3, said perspective taken as in FIG. 3.

FIG. 4 shows anchorage 40 mounted on door 10.

Figure 5:
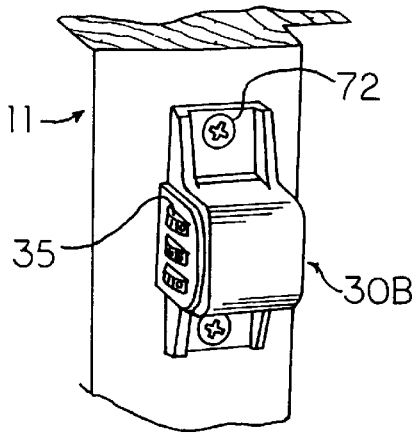
FIG. 5 is a perspective view of an alternate form of the door-frame mounted anchorage of the embodiment of the invention shown in FIGS. 2 and 3, said perspective taken as in FIG. 3.

FIG. 5 shows combination-operable anchorage 30B, which may be used in place of key-operable anchorage 30A, lug 21 having been suitably lengthened. Lockable engagement of said dual-strength connector 20 will then be effected and, subsequently, severed by working combination wheels 35. Anchorage 30B is shown attached to door-frame member 11 with ordinary, phillips screws 72.

A person seeking to open apartment door 10 can do so easily simply by pushing door 10 open, which will break the said low-strength seal 20A. Alternately, key 31 may be worked in cylinder 32 of anchorage 30A so as to release lug 21 of relatively high-strength coupler 20B, thereby preserving the integrity of said low-strength seal 20A. If combination-operable anchorage 30B should be employed, then dual-strength connector 20 will be released after the said combination wheels 35 have been worked in the said anchorage 30B, such that the correct combination has been entered, thereby once again preserving the integrity of low-strength seal 20A.

Figure 6:
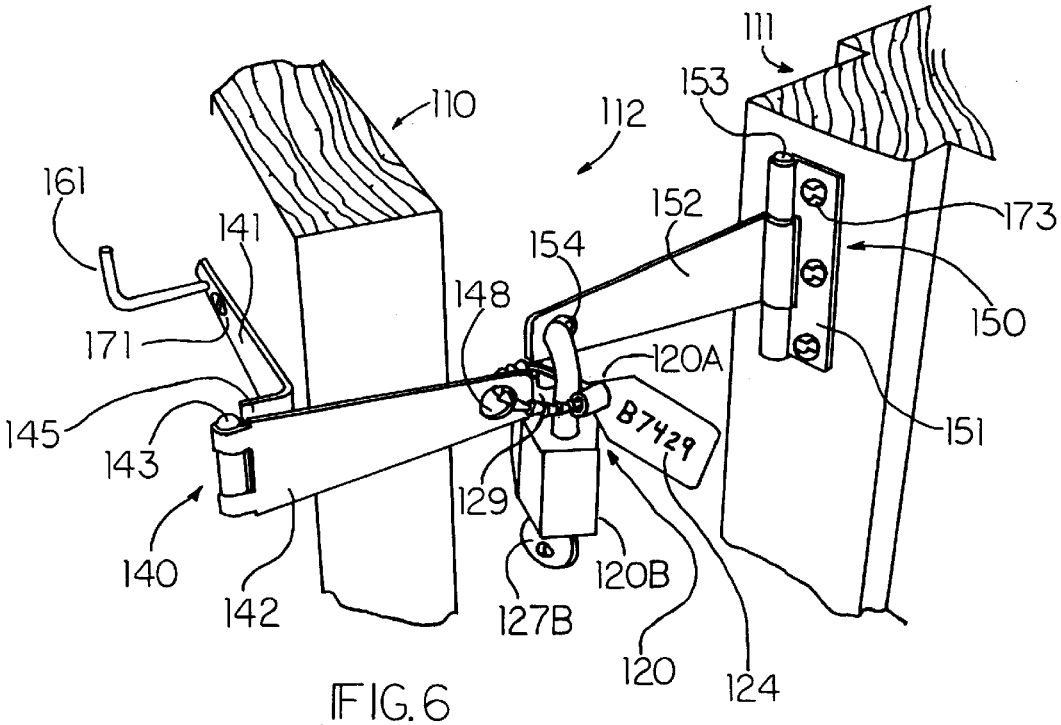
FIG. 6 is a perspective view of an alternate embodiment of the present invention mounted to a door and door-frame member, said door being shown ajar, and showing two anchorages mounted, respectively, to the said door and said door-frame frame member, and further showing said anchorages connected to one another by a dual-strength connector, said perspective taken from a point slightly above a plane perpendicular to the plane of the said door.

FIG. 6 shows an apartment door 110 and door-frame member 111 with gap 112 between then when door 110 is ajar. On door-frame member 111 is mounted anchorage 150 of an alternate embodiment of the invention. Said anchorage 150 is made of metal, is similar in form to a T-hinge, and comprises a solid, pivoted plate 152, a mounting plate 151, and a hinge pin 153. Said mounting plate 151 is shown attached to said door-frame member 111 with one-way, security screws 173. A second anchorage 140 of this alternate embodiment of the present invention is shown mounted to door 110. Said anchorage 140 is made of metal and comprises mounting plate 141, pivoted plate 142, and hinge pin 143, and resembles in form a strap hinge, but with a modification to mounting plate 141. Said modification consists of an essentially right angle bend in mounting plate 141 so as to form short segment 145 roughly perpendicular to door 110. Said short segment 145 serves to keep mounting plate 141 from contacting door-frame member 111 when door 110 is closed. Hook 161 is shown extending through mounting plate 141. Dual-strength connector 120 comprises low-strength seal 120A, preferably made of plastic, and relatively high-strength coupler 120B, preferably made of metal. Said relatively high-strength coupler 120B is shown to be in the form of a padlock operable by means of key 127B. Dual-strength connector 120 reversibly and lockably engages anchorage 150 by means of the engagement of high-strength coupler 120B with aperture 154 of pivoted plate 152, and irreversibly engages anchorage 140 by means of the irreversible engagement of low-strength seal 120A with aperture 148 of pivoted plate 142. Said anchorage 150 in combination with dual-strength connector 120 and anchorage 140 together form a connected span linking said door 110 with said door-frame member 111. The said span is sufficiently short as to prevent a human being from squeezing between the said door and said door frame. The said span may be severed by either working key 127B in coupler 120B, or by breaking low-strength seal 120A.

Figure 7:
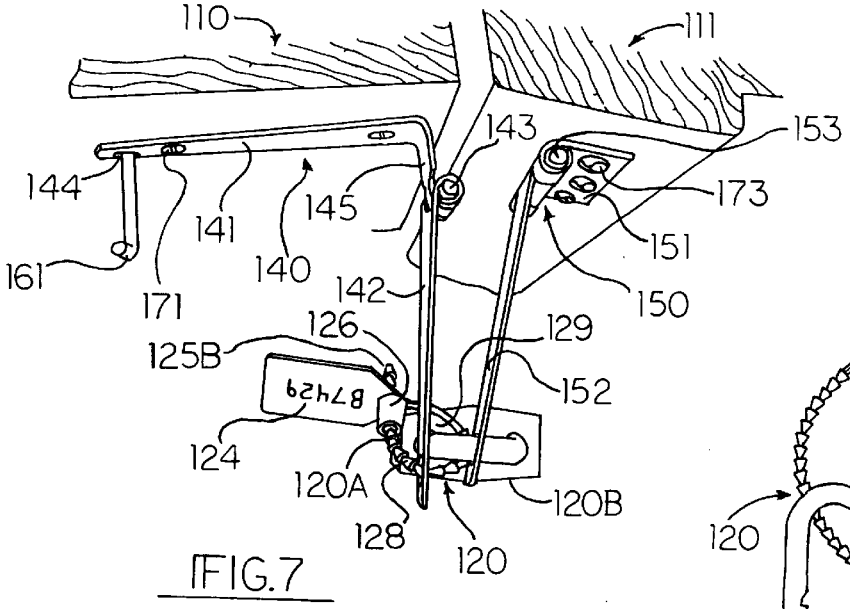
FIG. 7 is a perspective view of the alternate embodiment of the invention shown in FIG. 6, said door being shown closed, and said perspective being taken from a steep angle to a plane perpendicular to the plane of the said door.

FIG. 7 shows the alternate embodiment of the present invention attached to the said door 110, the door being shown closed. Said anchorage 140 is shown attached to said door 110 with ordinary, slotted screws 171. Anchorage 140 is shown connected to anchorage 150 by means of dual-strength connector 120. Said low-strength seal 120A is shown irreversibly engaged with itself to form loop 129 and with truncated end 125B. Said anchorage 150 is shown attached to door-frame member 111 with one-way, security screws 173. Hook 161 emerges from aperture 144 in plate 141.

Figure 8:
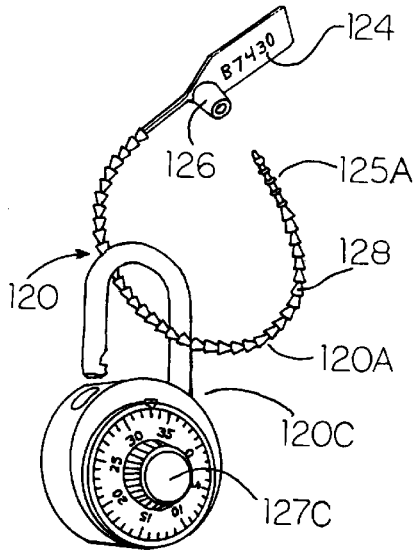
FIG. 8 is a perspective view of an alternate form of the dual-strength connector shown in FIGS. 6, 7, and 9, showing said alternate form lying on a plane, said perspective being taken from the left of a perpendicular dropped to the said plane.
Figure 9:
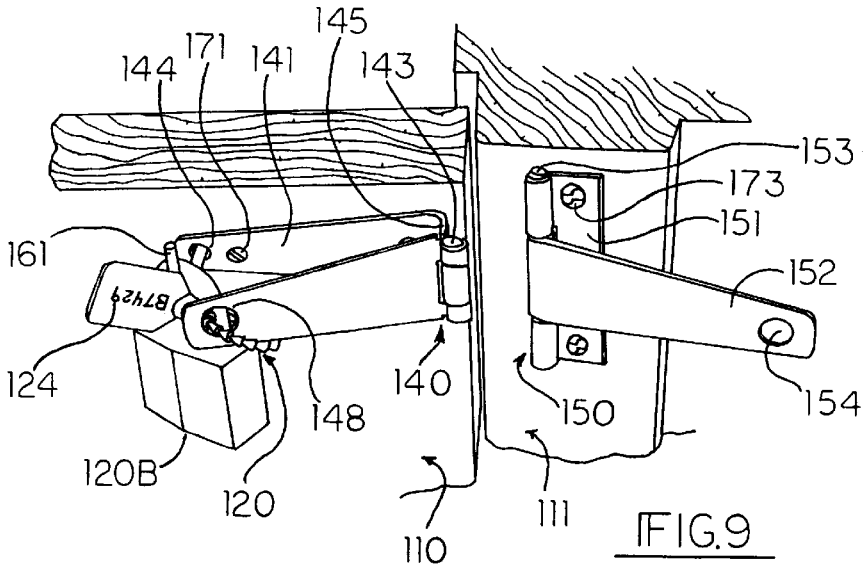
FIG. 9 is a perspective view of the alternate embodiment of the invention shown in FIGS. 6 and 7, but showing the said anchorages unconnected, said perspective being taken from slightly above a plane perpendicular to the plane of the said door.

FIG. 8 shows an alternate form of the said dual-strength connector 120. The relatively high-strength coupler 120B of FIGS. 6, 7 and 9, shown in those figures to be a key-operated padlock, has been replaced in FIG. 8 by relatively high-strength coupler 120C, shown to be a combination-operable padlock, operable by working combination wheel 127C. Low-strength seal 120A with serial number 124 is shown full length, with short, narrow, male end 125A, much longer midsection 128, and female-receptacle element 126. Male end 125A is to be inserted into and drawn irreversibly through female-receptacle element 126, as provided for by the seal manufacturer. Said low-strength seal 120A is thereby capable of a size adjustment, as male end 125A is pulled irreversibly through the female-receptacle element 126. The recommended size for the resulting loop 129 will depend on the actual lengths of plates 142 and 152, the relative placements of anchorages 140 and 150, as well as on the actual alignment of door 110 with door-frame member 111. In general, the optimum loop size will be that which just allows the anchorages 140 and 150 to be connected by the dual-strength connector 120, in the manner shown in FIG. 7, when the door 110 is closed, and that further just allows the device, when disengaged, to be easily stowed, as shown in FIG. 9. Breakage of the seal 120A, after it has been optimally sized, will render reuse of the seal no longer practically possible FIG. 9 shows the said alternate embodiment of the present invention in the stowed position, with said dual-strength connector 120 draped over hook 161.

A person seeking to open apartment door 110 can do so easily simply by pushing door 110 open, which will break low-strength seal 120A. If key-operable form 120B of the relatively high-strength coupler is employed, then said relatively high-strength coupler 120B will be disengaged from anchorage 150 by working key 127B. Alternatively, if combination-operable form 120C of the relatively high-strength coupler is employed, then said relatively high-strength coupler 120C will be disengaged from anchorage 150 by working combination wheel 127C until the correct combination has been entered. In both the key and combination-operable instances, the integrity of seal 120A is preserved.

Yet another embodiment of the present invention may be formed by replacing plate 142 of anchorage 140 and plate 152 of anchorage 150 with lengths of flexible cable, said lengths being attached either mechanically or by welding to the respective anchorages, each said length having a free end to which a metal eye has been permanently affixed, or in which a loop has been formed by a cable clinch, said eye or, alternatively, said loop functioning analogously to the apertures 148 and 154 in plates 142 and 152, respectively.

I claim:

1. An anti-snooping device adapted to be attached to a door and a door frame comprising a dual-strength connector, a door-mounted anchorage, and a door-frame-mounted anchorage, said dual-strength connector comprising a low-strength seal and a relatively high-strength coupler, said high-strength coupler capable of lockably engaging at least one of the said anchorages, said lockable engagement of said high-strength coupler being severable by the operation of a key, said low-strength seal being capable of engaging said high-strength coupler and further being capable of engaging the anchorage not engaged by said high-strength coupler, said dual-strength connector and said anchorages, after said high-strength coupler has been lockably engaged with one said anchorage and said low-strength seal has been engaged both with said high-strength coupler and with the anchorage not engaged by said high-strength coupler, in combination forming a span connecting said door to said door frame, said span being sufficiently long as to allow said door to be set ajar without breaking said low-strength seal, but said span being sufficiently short as to prevent a human being from passing between said door and said door frame without breaking said low-strength seal after said door has been set ajar, said span further being severable by the operation of said key or by the action of breaking said low-strength seal.

2. A device as set forth in claim 1 in which said span is sufficiently long as to permit said low-strength seal to be drawn in its entirety into the gap between said door and said door frame without breaking said low-strength seal when said door is set ajar.

3. A device as set forth in claim 1 in which one said anchorage comprises a link chain and a mounting device, said mounting device communicating with one end of said link chain.

4. A device as set forth in claim 1 in which said low-strength seal is adjustable.

5. A device as set forth in claim 1 in which said low-strength seal carries a serial number.

6. A device as set forth in claim 1 in which a hook is provided over which to drape said dual-strength connector when said anti-snooping device is not in use.

7. A device as set forth in claim 1 in which one or both of said anchorages are attached to one or both of said door and said door frame with one-way, security screws.

8. A device as set forth in claim 1 in which at least one said anchorage comprises a solid, pivoted plate and a mounting device.

9. An anti-snooping device adapted to be attached to a door and a door frame comprising a dual-strength connector, a door-mounted anchorage, and a door-frame-mounted anchorage, said dual-strength connector comprising a low-strength seal and a relatively high-strength coupler, said high-strength coupler capable of lockably engaging at least one of the said anchorages, said lockable engagement of said high-strength coupler being severable by the entry of a combination, said low-strength seal being capable of engaging said high-strength coupler and further being capable of engaging the anchorage not engaged by said high-strength coupler, said dual-strength connector and said anchorages, after said high-strength coupler has been lockably engaged with one said anchorage and said low-strength seal has been engaged both with said high-strength coupler and with the anchorage not engaged by said high-strength coupler, in combination forming a span connecting said door to said door frame, said span being sufficiently long as to allow said door to be set ajar without breaking said low-strength seal, but said span being sufficiently short as to prevent a human being from passing between said door and said door frame without breaking said low-strength seal after said door has been set ajar, said span further being severable by the entry of said combination or by the action of breaking said low-strength seal.

10. A device as set forth in claim 9 in which said span is sufficiently long as to permit said low-strength seal to be drawn in its entirety into the gap between said door and said door frame without breaking said low-strength seal when said door is set ajar.

11. A device as set forth in claim 9 in which one said anchorage comprises a link chain and a mounting device, said mounting device communicating with one end of said link chain.

12. A device as set forth in claim 9 in which said low-strength seal is adjustable.

13. A device as set forth in claim 9 in which said low-strength seal carries a serial number.

14. A device as set forth in claim 9 in which a hook is provided over which to drape said dual-strength connector when said anti-snooping device is not in use.

15. A device as set forth in claim 9 in which one or both of said anchorages are attached to one or both of said door and said door frame with one-way, security screws.

16. A device as set forth in claim 9 in which at least one said anchorage comprises a solid, pivoted plate and a mounting device.

* * * * *